United States Patent [19]

Noble

[11] Patent Number: 4,607,674

[45] Date of Patent: Aug. 26, 1986

[54] COVER SYSTEM

[76] Inventor: Peggy Noble, 3604 Forest Hill Rd., Baltimore, Md. 21207

[21] Appl. No.: 677,395

[22] Filed: Dec. 3, 1984

[51] Int. Cl.[4] ..... B65D 11/00

[52] U.S. Cl. ..... 150/52 R; 446/100; 446/99

[58] Field of Search ..... 150/52 R; 446/100, 99

[56] References Cited

U.S. PATENT DOCUMENTS

| | | | |
|---|---|---|---|
| D. 152,173 | 12/1948 | Seider | 150/52 R |
| D. 153,464 | 4/1949 | Rubenstein et al. | 150/52 R |
| 883,492 | 2/1911 | Harriss | 150/52 R |
| 1,407,165 | 2/1922 | Pajeau | 150/52 R |
| 1,566,801 | 12/1925 | Millard | 446/99 |
| 3,704,776 | 12/1972 | Collins | 150/52 R |

FOREIGN PATENT DOCUMENTS

| | | | |
|---|---|---|---|
| 2013508 | 8/1979 | United Kingdom | 446/100 |

*Primary Examiner*—Joseph Man-Fu Moy
*Attorney, Agent, or Firm*—Morton J. Rosenberg

[57] ABSTRACT

A cover system (10) which simultaneously serves as an ornamental decoration and a storage container for a toilet roll (12). The cover system (10) is in the overall contour of a figure member and includes a body member (14), a head member (46), and a plurality of appendages (26, 28, 30 and 32). The head member (46) is releasably securable to the body member (14) by use of Velcro fasteners and allows interchangeability of variously designed heads (46 and 46'). Additionally, the appendages (26, 28, 30 and 32) provide for a positional maintenance mechanism (40) which allows the user to maintain a predetermined positional contour set by the user for the appendages (26, 28, 30 and 32). Additionally, the cover system (10) includes a scent mechanism (52 and 52') which may be releasably mounted and secured to the cover system (10) to provide a pleasing odoriferous scent. In order to further allow changeability of cover system (10) to a compatible aesthetic interfacing with the surrounding decor, clothing members (62 and 64) may be mounted on cover system (10). In this manner, there is provided an ornamental cover system (10) which simultaneously serves as a storage container.

18 Claims, 3 Drawing Figures

FIG. 1
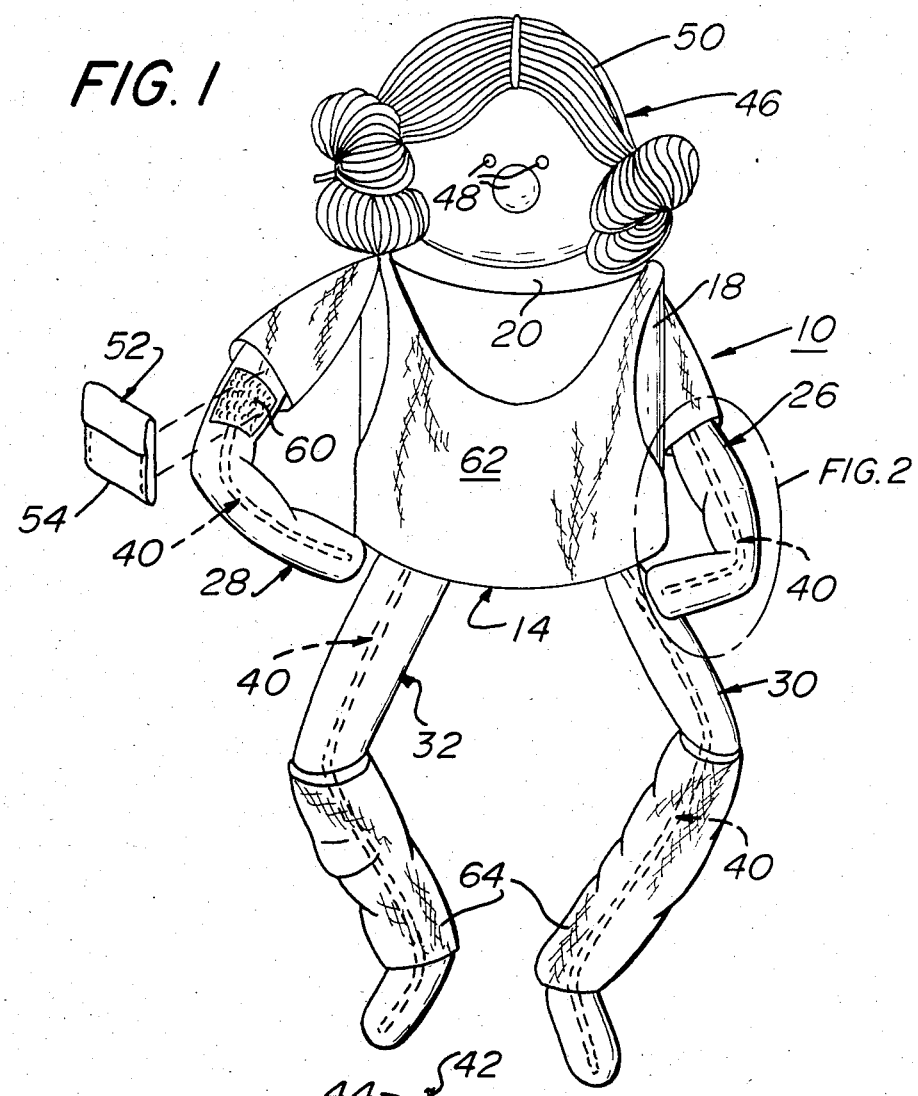
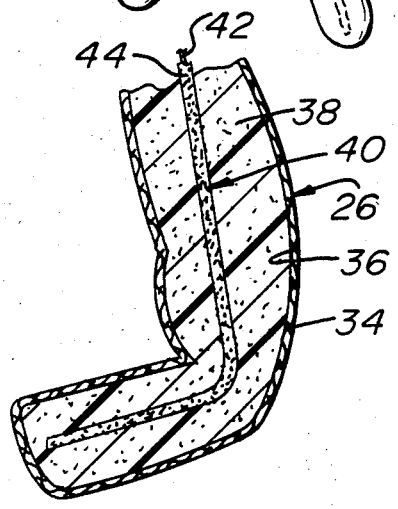
FIG. 2

COVER SYSTEM

BACKGROUND OF THE INVENTION

1. Field of the Invention

This invention pertains to cover systems which may serve as a storage container for various objects, such as toilet rolls. More in particular, this invention directs itself to an ornamental cover system taking the form of a doll-like figure having a body portion, a head portion; and a plurality of appendages. More in particular, this invention pertains to a cover system formed of flexible layers of material composition wherein appendages include a positional maintenance mechanism contained therein to allow the user to position the appendages to a predetermined contour which is maintained. Further, this invention pertains to a cover system which allows the user to interchange body parts such as the head member to accomodate changing decor of the surrounding environs. More in particular, this invention pertains to a cover system which includes a removable scent mechanism to provide a pleasing odoriferous scent to the surrounding environment.

2. Prior Art

Cover systems adapted to contain items such as toilet rolls are known in the prior art. The best prior art known to the Applicant includes U.S. Pat. Nos. 2,538,123; 2,534,290; 2,704,903; 3,507,416; 1,210,892; 3,704,776; 1,868,853; 1,333,428; Des. 176,842; 3,003,284; 2,031,851; Des. 213,837; and, Des. 213,884.

In U.S. Pat. No. 2,538,123, there is provided a doll like cover for hot water bottles. Such includes a doll head having a neck portion with a hood or cape. The body or dress for the doll-like configuration is attached to a flange and covers the hot water bottle. Such prior art systems do provide for a covering for an inserted body, however, the head member is not detachable and does not allow changing and different aesthetic effects to be provided, as in the case of the subject invention concept.

Other prior art systems, such as that shown in U.S. Pat. No. 2,534,290 direct themselves to a toilet roll paper container. In such prior art systems, there is provided a base within which the toilet rolls are inserted. Toilet tissue rolls are stacked vertically within the container, however, the overall contour of such prior art systems do not provide for the concept of aesthetically differing variations as is provided in the subject invention concept.

In other prior art systems, such as that shown in U S. Pat. No. 2,704,903, there is provided a cover system for various articles of general utility. Such does provide for skirt portions secured about the waist of the doll-like figure and also includes appendages. Such prior art systems do provide for a head member with a plurality of articles insertable within the skirt portion of the overall contour. However, although certain portions of the doll-like configuration are removable, such does not provide for the particular positioning of the appendages through use of a positional maintenance mechanism, as is provided in the subject invention concept.

Other prior art systems, such as that shown in U.S. Pat. No. 3,704,776 are specifically directed to bathroom accessories for covering toilet rolls. However, such merely provides for cylinders which appear to be substantially rigid and do not provide for the particular contour covering with the changeability aspects of the subject invention concept to cooperate with the surrounding environment.

SUMMARY OF THE INVENTION

A cover system which is adapted to contain toilet rolls and includes a body member defining an internal chamber having a volumetric contour adapted for insert of the toilet roll. The cover system includes at least one appendage member fixedly secured to the body member and a head member which is releasably secured to the body member.

An object of the subject invention is to provide a cover system for storage of articles contained therein in an aesthetically pleasing manner.

It is a further object of the subject invention to provide a cover system adapted to serve as a container for toilet rolls as a bathroom accessory.

It is a further object of the subject invention concept to provide a figurine or doll-like figure having members thereof which may be interchanged to cooperate and enhance the surrounding environment as well as to cooperate aesthetically with the decor.

It is an object of the subject invention to provide a doll-like figure which is generally flexible in nature however, which may be further include a positional maintenance mechanism to predeterminedly configure the doll-like appendages in a stabilized manner.

It is a still further object of the subject invention to provide a cover system which allows for changeability of design through use of clothing members releasably securable to the cover system in a manner which enhances the overall aesthetic effect.

Additionally, it is an object of the subject invention concept to provide a cover system which has a scent mechanism releasably detachable to the cover system at the discretion of the user.

BRIEF DESCRIPTION OF THE DRAWINGS

FIG. 1 is a perspective partially exploded view of the subject cover system;

FIG. 2 is an exploded sectional view of a portion of an arm appendage of the cover system showing the internal positional maintenance mechanism; and, FIG. 3 is a sectional view of the cover system showing a toilet roll and a plurality of head members which may be releasably attached to the body member of the overall cover system.

DESCRIPTION OF THE PREFERRED EMBODIMENTS

Figure 3:
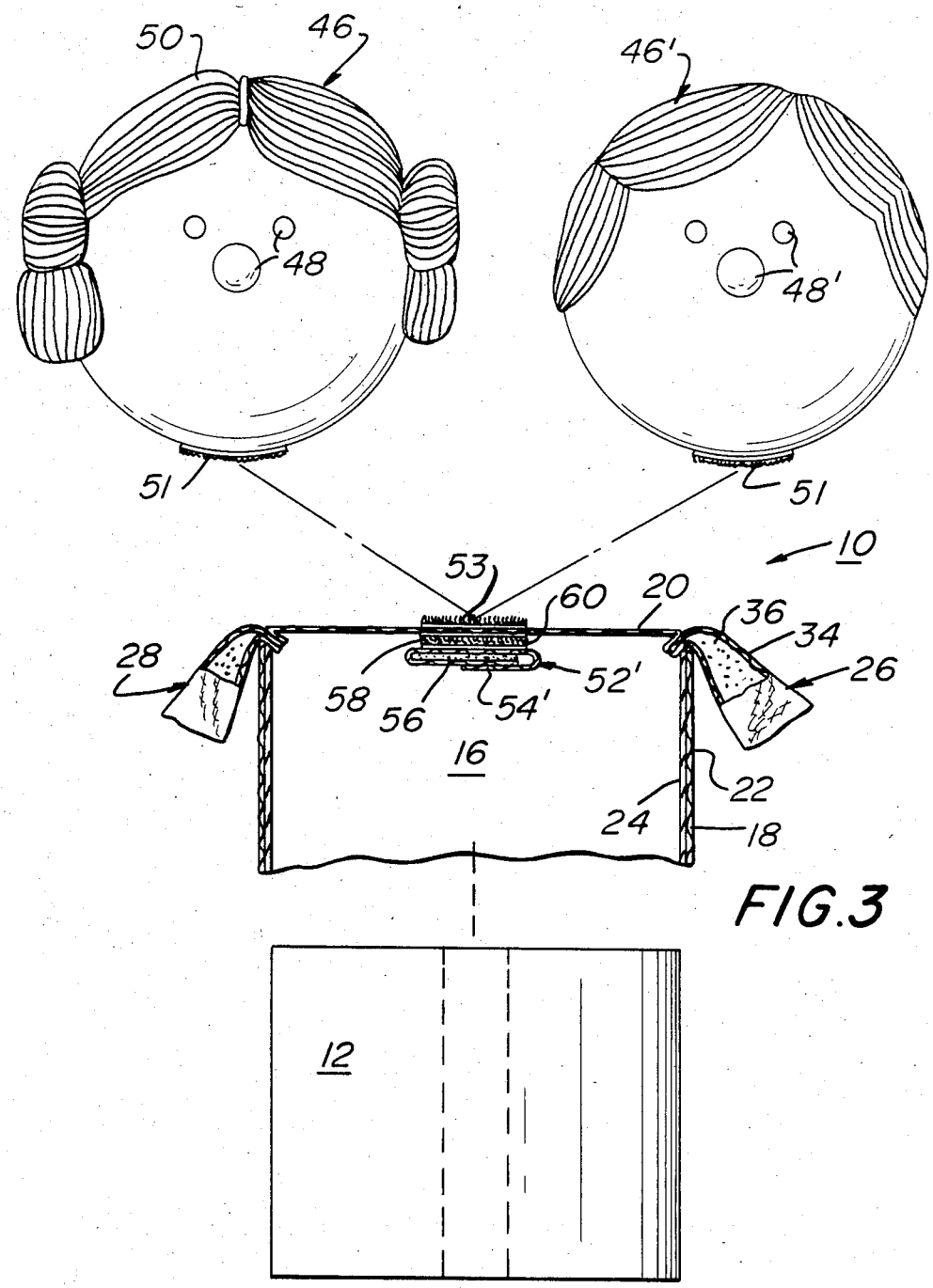

Referring now to FIGS. 1–3, there is shown cover system 10 adapted to contain toilet roll 12. Cover system 10 is utilizable as an ornamental figure while simultaneously allowing the user to contain toilet roll 12 without toilet roll 12 being exposed to view. In this manner, cover system 10 may be maintained or located in the lavatory and serves as an aesthetic device having utility as a storage container. Further, cover system 10 is in the general contour of a figure or doll-like system which has interchangeable members that can be rearranged responsive to the surrounding environs and furnishings so as to optimize the aesthethic effect of cover system 10. Further, the overall general design of cover system 10 may be rearranged at the discretion of the user by providing different clothing having particular color schemes and/or designs which would further optimize the aesthetic effects of cover system 10. Thus, there is provided cover system 10 which in particular may be adapted to contain toilet roll 12 and has the capability of being changeable or varied to coincide and cooperate with the surrounding decor.

Cover system 10 includes body member 14 which defines internal chamber 16 shown in FIG. 3, having a volumetric contour adapted for insert of toilet roll 12. Body member 14 includes flexible body sidewall member 18 and flexible body top member 20. Flexible body top member 20 is fixedly secured to flexible body sidewall member 18 at an upper edge of sidewall member 18. Securement between top member 20 and sidewall member 18 may be through stitching, or some like technique, not important to the inventive concept as herein described.

Flexible body sidewall member 18 includes outer body sidewall member 22. Outer body sidewall member 22 may be formed of a textile composition, or in the alternative, may be formed of a synthetic fabric material. Flexible body sidewall member 18 further includes inner body sidewall member 24 as shown in FIG. 3, which is secured to outer body sidewall member 22. Inner body sidewall member 24 is generally formed of a flexible composition material layer having a rigidity greater than outer body sidewall member 22, while simultaneously being flexible in nature. Outer body sidewall member 22 is fixedly secured to inner body sidewall member 24 through stitching, bonding, adhesive securement, or some like technique, not important to the inventive concept, as is herein described.

In this manner, body member 14 includes flexible body sidewall member 18 which in itself is a somewhat laminated type sidewall member providing some rigidity in order to allow ease of passage over toilet roll 12. Flexible body top member 20 may be formed of the same material composition as outer body sidewall member 22 and thus, may be formed of a natural or synthetic fabric material.

Flexible body sidewall member 22 and body top member 20 in combination provide for a substantially cylindrically contoured internal chamber 16 which matingly interfaces with toilet roll 12 when such is being inserted internal cover system 10. Further, as is clearly understood, when toilet roll 12 is inserted within cover system 10, toilet roll 12 is not viewable to an external viewer. As has been stated, inner body sidewall member 24 is formed of a flexible composition having a rigidity greater than outer body sidewall member 22 and in a preferred form, may be formed of crinoline, which allows for flexibility of body member 14 while simultaneously allowing for some rigidity to the structure of body member 14.

Cover system 10 further includes a plurality of appendages 26, 28, 30 and 32 which are fixedly secured to body member 14. The construction of all appendages 26, 28, 30, and 32 are basically substantially the same, and thus, the following description will relate and direct itself to arm appendage member 26, the same substantially general construction being applied to all of appendage members 26, 28, 30 and 32.

Appendage member 26 includes outer appendage layer member 34 forming an enclosed appendage chamber 36, which is clearly shown in FIG. 2. Outer appendage layer member 34 may be formed of the same natural and/or synthetic material composition as that provided for outer body sidewall member 22. Resilient material composition element 38 is inserted within enclosed appendage chamber 36 and substantially fills appendage chamber 36. Resilient material composition member 38 may be a fibrous material and may be formed of a natural fabric material, such as cotton, or in the alternative, may be a foam synthetic type material composition, not important to the inventive concept as is herein described.

Additionally, there is provided positional maintenance mechanism 40 inserted within appendage members 26, 28, 30 and 32 in order to allow maintenance of a positional contour of appendage members 26, 28, 30 and 32 subsequent to an initial placement contour. Positional maintenance mechanism 40 includes wire member 42 extending at least through a portion of resilient material composition member 38 within appendage members 26, 28, 30 and 32. Wire member 42 may have secured thereto on an outer wall thereof, a plurality of fibrous elements or members 44 which substantially encompass the external surfaces of wire member 42. Positional maintenance mechanism 40 may thus be formed of a commercially available product, such as a pipe cleaner which allows the user to displace and contour a particular appendage member 26, 28, 30 or 32 and subsequent to such a displacement and contouring, the appropriate appendage, such as 26, would thus substantially remain in fixed positional contour as desired by the user.

Cover system 10 further includes head member 46 which is releasably secured to body member 14. Head member 46 may include various indicia or elements 48 giving the user the impression of a face. Additionally, hair 50 may be secured to an outer peripheral surface of head member 46. Head member 46 may be formed generally of the same material composition as that of outer appendage layer member 34 or outer body sidewall member 22. Additionally, head member 46 may contain a resilient material composition similar in nature to resilient material composition member 38 insertable within appendages 26, 28, 30 and 32. In this manner, head member 46 maintains some structural integrity for mounting on body member 14.

In general, head member 46 is releasably coupled and specifically adhesively coupled to flexible body top member 20 as is clearly shown in FIG. 1. As shown in FIG. 3, head member 46 and body top member 20 may include Velcro cooperation members 51 and 53 for releasably securing head member 46 to flexible body top member 20. In this manner, head member 46' having a different facial expression, differing indicia 48', or otherwise providing a different design feature, may be interchanged with head member 46 to provide a more aesthetic cover system 10 as a function of the surrounding environs.

Cover system 10 may also include scent mechanism 52 and 52' which is releasably coupled to a surface of cover system 10 for providing a pleasing odorous scent over a period of time. As can be seen in FIGS. 1 and 3, scent mechanism 52, 52' may include pouch member 54, 54' which is releasably secured to a surface of cover system 10. Sachet element 56 may be insertable within pouch members 54 and/or 54'. Pouch members 54 and 54' are generally adhesively coupled to a surface of cover system 10. As can be seen in FIGS. 1 and 3, pouch members 54 and 54' in combination with the surface of cover system 10 wherein pouch members 54 and 54' are to be releasably coupled may include cooperating Velcro elements 58 and 60 for releasable attachment of pouch members 54 and 54' to cover system 10.

As seen in FIG. 1, pouch member 54 is releasably coupled to appendage member 28 of cover system 10.

Obviously, pouch member 54 may be coupled to any exterior surface of cover system 10 at a positional location acceptable to the user. As is seen in FIG. 3, pouch member 54' is releasably coupled to body member 14 within internal chamber 16 and thus, scent mechanism 52' is not viewable to an external viewer.

Cover system 10 further may include clothing such as shirt member 62 fitted over body member 14 and leg warmers 64 insertable over leg appendages 30 and 32. Particular clothing members 62, 64 are not important to the inventive concept as herein described, with the exception that such can be used to provide differing design changes to cover system 10 and allow increased optimizatio of the aesthetic values of cover system 10 during use. Clothing members 62 and 64 may be formed of a textile-like composition and in general, may be a fabric either natural or synthetic and having varying indicia contained thereon.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A cover system adapted to contain a toilet roll comprising:

(a) a body member defining an internal chamber having a volumetric contour adapted for insert of said toilet roll;

(b) at least one appendage member having an extended length and fixedly secured to said body member, said appendage member including an outer appendage layer member forming an enclosed appendage chamber and a resilient material composition inserted within said enclosed appendage chamber;

(c) a head member releasably secured to said body member; and, (d) means for varying and maintaining a positional contour of said appendage member substantially throughout said extended length of said appendage member, said means for varying and maintaining said positional contour passing through at least a portion of said resilient material composition.

2. The cover system as recited in claim 1 where said body member includes:

(a) a flexible body sidewall member; and, (b) a flexible body top member fixedly secured to said flexible body sidewall member at an upper edge thereof.

3. The cover system as recited in claim 2 where said flexible body sidewall and body top member combination provide for a substantially cylindrically contoured internal chamber for mating interface of said inserted toilet roll.

4. The cover system as recited in claim 2 where said flexible body sidewall member includes:

(a) an outer body sidewall member formed of a textile composition; and, (b) an inner body sidewall member secured to said outer body sidewall member, said inner body sidewall member being formed of a flexible composition having a rigidity greater than said outer body sidewall member.

5. The cover system as recited in claim 4 where said inner body sidewall member flexible composition is crinoline.

6. The cover system as recited in claim 1 where said means for maintaining said positional contour of said appendage includes a wire member extending through said portion of said resilient material composition.

7. The cover system as recited in claim 6 where said wire member has secured thereto a plurality of fibrous elements substantially encompassing said wire member.

8. The cover system as recited in claim 2 where said head member is releasably secured to said flexible body top member of said body member.

9. The cover system as recited in claim 8 where said head member is adhesively coupled to said flexible body top member of said body member.

10. The cover system as recited in claim 9 where said head member and said flexible body top member include Velcro cooperating members for releasably securing said head member to said flexible body top member.

11. The cover system as recited in claim 1 including scent means releasably coupled to a surface of said cover system for providing a pleasing odorous scent.

12. The cover system as recited in claim 11 where said scent means includes:

(a) a pouch member releasably secured to a surface of said cover system; and, (b) a sachet element insertable within said pouch member.

13. The cover system as recited in claim 12 where said pouch member is adhesively coupled to a surface of said cover system.

14. The cover system as recited in claim 13 where said pouch member and said surface of said cover system include cooperating Velcro elements for releasable attachment of said pouch member to said cover system.

15. The cover system as recited in claim 13 where said pouch member is releasably coupled to said appendage member of said cover system.

16. The cover system as recited in claim 13 where said pouch member is releasably coupled to said body member.

17. The cover system as recited in claim 16 where said pouch member is releasably coupled to said flexible body top member within said internal chamber.

18. The cover system as recited in claim 1 including clothing means releasably applied to said body member and said appendage member.

* * * * *